United States Patent [19]

Lenson

[11] 4,308,812

[45] Jan. 5, 1982

[54] EMBROIDERY MACHINE HAVING IMPROVED THREAD SUPPLY SYSTEM

[76] Inventor: Harry Lenson, 822 E. Lawn Dr., Teaneck, N.J. 07666

[21] Appl. No.: 130,980

[22] Filed: Mar. 17, 1980

[51] Int. Cl.[3] ..... D05C 3/04; D05C 11/08

[52] U.S. Cl. ..... 112/97

[58] Field of Search ..... 112/97, 96, 83, 90, 112/93, 243, 302

[56] References Cited

U.S. PATENT DOCUMENTS

| | | | |
|---|---|---|---|
| 876,562 | 1/1908 | Kleutgen | 112/83 X |
| 2,497,359 | 2/1950 | Isabelle | 112/302 |
| 3,356,050 | 12/1967 | Urscheler | 112/97 |
| 3,968,759 | 7/1976 | Reich | 112/83 |

*Primary Examiner*—H. Hampton Hunter

*Attorney, Agent, or Firm*—Darby & Darby

[57] ABSTRACT

A coventional Schiffli embroidery machine is modified to accommodate cones of yarn of at least an order of magnitude 15 to 20 times greater by weight than that of conventionally used spools. The cones, preferably mounted above the machine, are directed to the machine needles by a thread guidance system including a plurality of angularly disposed guide plates. Also included is a device for producing tension in the threads from each of the cones before being supplied to the needles. Such an arrangement provides considerably longer operation of the machine over the conventional machine as well as improvement in the stitching quality of the embroidered patterns.

7 Claims, 7 Drawing Figures

EMBROIDERY MACHINE HAVING IMPROVED THREAD SUPPLY SYSTEM

BACKGROUND OF THE INVENTION

1. Field of the Invention

This invention relates to a conventional Schiffli embroidery machine improved to include means for using cones of yarn of substantially larger size than the conventional thread spools for increased efficiency of the embroidering operation and improved quality in the embroidered pattern.

2. Description of the Prior Art

Schiffli embroidery machines, commonly known as automatic shuttle embroidery machines are well known in the art and have been used for many years to embroider intricate patterns on a base fabric carried by the machine. An example of such a Schiffli embroidery machine and its operation is described in U.S. Pat. No. 3,460,495 by Walter L. Cobb, issued on Aug. 12, 1969. Such a machine commonly includes a frame for holding the base fabric in a substantially vertical plane and means for moving the fabric in the plane. Commonly included are a plurality of substantially horizontal, reciprocatably operating needles. A plurality of front thread spools, one associated with each of the needles, are provided to supply thread to the needles.

Typically the spools are mounted in relatively close proximity to the needles, the thread from the spools being fed through a tension mechanism and then to the needles. The spools are relatively lightweight, on the order of several ounces, and are generally slidably mounted on spindles for ease of replacement and changeover.

Such a spool arrangement is advantageous in so-called "novelty" work wherein a variety of different denier threads or yarns such as rayons, cottons and acetates in various colors may be used to embroider patches, emblems, uniforms and the like. A facility for readily changing spools for the various patterns is desirable.

However, in the embroidery of so-called "staples" such as laces and gray goods the same color or shade of thread, all of substantially constant denier, and the same number of needles are often repetitively used. In such repetitive work, the conventional spool arrangement is disadvantageous. In the embroidering of staples, it is desirable to have the machine run continuously for relatively long periods of time since changing the threads is not necessary. Since the spools have only several ounces of thread, they become depleted fairly often. It becomes necessary for an operator to observe the spools, oftentimes several hundred, and to replace those that become depleted. Typically, all the spools that run empty are not detected resulting in undesirable spaces in the fabric where the pattern was to be embroidered. Conventional machines are usually equipped with devices that sense when a plurality of spools, for example ten, run empty simultaneously and automatically shuts off the machine to enable replacement of the spools. Such an arrangement is inefficient for production purposes, and relatively costly due to the need for operator attention and the down-time of the machine for spool replacement.

In addition to the empty spaces that result from depleted spools, another problem arises in the nonuniformity in the stitch of the pattern on the fabric. As the spool becomes depleted and its weight less, it provides very little pulling force to the tension mechanism thereby resulting in a decrease in tension in the thread. Lack of tension creates "loose" areas in the stitching and where the tension of the needles is uneven across the frame, the stitched pattern has a nonuniform appearance across the fabric. An improvement in the quality of the embroidered pattern as well as in the efficiency of operation is therefore desirable.

SUMMARY OF THE INVENTION

In accordance with the invention an improved automatic shuttle embroidery machine is provided. The machine is conventionally of the type comprising a frame for holding in a substantially vertical plane a fabric onto which a pattern is to be embroidered. Included is means for reciprocatably moving said frame along two perpendicular coordinates of the plane and a plurality of substantially horizontal reciprocatable needles supported on the machine for periodically stitching the fabric with thread. The needles are spaced along the frame in preferably substantially equal intervals. Means are provided for supplying thread to the needles including a plurality of cones of yarn that are mounted in an arrangement substantially proximate the needles wherein each one of the cones is respectively associated with a needle for supplying thread thereto. The diameters of the spools in the mounting arrangement are determined by the spaced interval between needles. According to the invention the spools in the thread supply means are replaced by a plurality of cones of thread mounted preferably at a location above the needles. Included in the improvement is means for supporting cones having a diameter greater than the diameter of the spools. Also included is means for producing tension in the thread from each cone. Interposed between the cones and the needles are means for guiding the threads under tension along a fixed path from each of the cones to a respective one of the needles.

In a preferred form of the invention, the threads on each of the cones are substantially the same denier, the cones having a diameter such that the weight of the thread is at least an order of magnitude greater than the weight of thread on conventional spools. Such an arrangement provides an advantage of increasing the duration that the machine can be operated to embroider patterns without depleting the thread supply and shutting the machine down for replacements or changeovers. Furthermore, the improved arrangement minimizes the occurrence of empty spaces in the patterns and provides a substantially even tight stitch across the fabric due to the uniform tension provided in the threads from the cones.

DETAILED DESCRIPTION OF THE PREFERRED EMBODIMENTS

Figure 1:
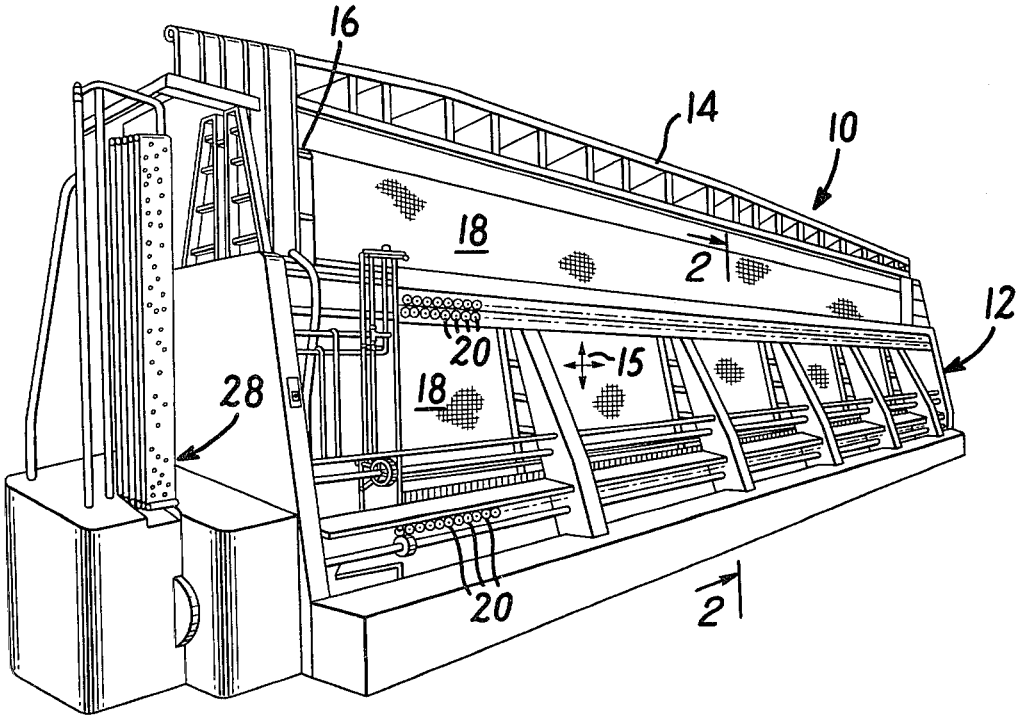
FIG. 1 PRIOR ART
FIG. 1 is a perspective view of a conventional prior art Schiffli embroidery machine.
Figure 2:
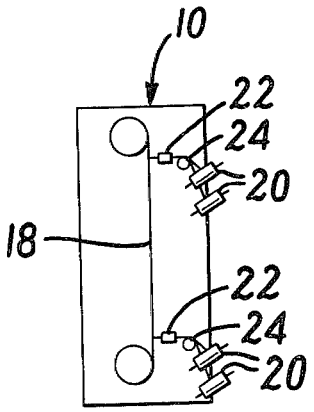
FIG. 2 PRIOR ART
FIG. 2 is a sectional view of the machine of FIG. 1 as seen along viewing lines 2—2.

Referring to the drawing there is shown in FIG. 1, a conventional prior art Schiffli embroidery machine 10 over which the present invention is an improvement. The machine 10 comprises a base support 12 on which a frame 14 is mounted for vertical and horizontal movement as shown by the arrows 15. The frame is provided with support means 16 for supporting a base fabric 18 in a substantially vertical plane. Supported on the base 12 are a plurality of front thread spools 20 which are employed to supply thread spools embroidering a pattern on the fabric 18. As best seen in FIG. 2, the machine 10 also includes a plurality of horizontally reciprocatable needles 22 arranged substantially across the length of the frame 14 in two rows, one each at the upper and lower portions of the fabric 18. The spools 20 supply thread to the needles 22 in a path that may be traced from the spool 20 to an emery roller 24 and around the emery roller 24 several turns and thence to the needle 22. Tension mechanisms (not shown) may be used between the spools 20 and the needles 22. As is known in the art, the emery roller 24 is commonly an elongated felt covered roller. The emery roller 24 may be considered a passive element in that there is no means for rotating the roller, it being rotated by the pull of the thread which is wrapped therearound. The reciprocation of each of the needles 22 and the vertical and horizontal movement of the frame 14 are all imparted in the well-known conventional manner on standard Schiffli embroidery machines as described, for example, in U.S. Pat. No. 3,460,495 and are preferably controlled, as is well-known, by a jacquard-type automat 28 as shown in FIG. 1.

Figure 3:
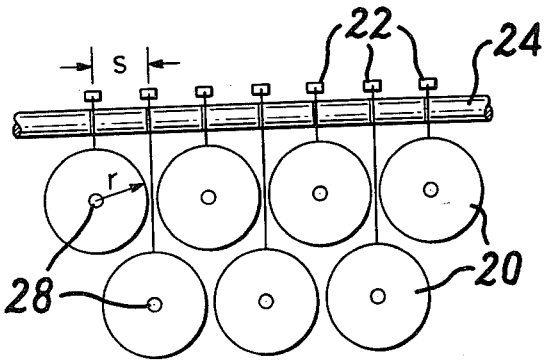
FIG. 3 PRIOR ART
FIG. 3 is a front elevational fragmentary view of the machine of FIG. 1 showing two rows of thread spools in the conventional arrangement for supplying thread to the needles.

Referring now to FIG. 3, the spools 20 are shown in their conventionally mounted arrangement. In this arrangement there are two rows of spools that extend along the base support 12 of the machine for each row of needles 22. The spools 20 in each row are substantially equally spaced, the lower row being staggered with respect to the upper row such that the centers of the lower row of spools 20 are substantially between the centers of the upper row of spools. The spools 20 are mounted on spindles 28 proximate the needles 22 for relatively ease of replacing spools and rethreading the needles 22. In this conventional arrangement of two rows of spools 20, the diameter of the spools 20 is effectively determined and limited by the spaced interval, s, between the needles 22, the needles 22 being substantially equally spaced. To be accommodated along the machine in such an arrangement, the radius, r, of each of the spools 20 is less than the spacing, s, between the needles 22. In one machine, for example, the needles 22 are spaced approximately one (1.0) inch apart. The diameter of the spools 20 is somewhat less than two (2.0) inches, such a spool containing about 2.0–3.0 ounces of lace thread. As set forth hereinabove such a relatively small spool is advantageous where replacement and changeover is often required such as in novelty work, but for continuous embroidering of repetitive patterns, for example, such a thread supply arrangement is undesirable.

Figure 4:
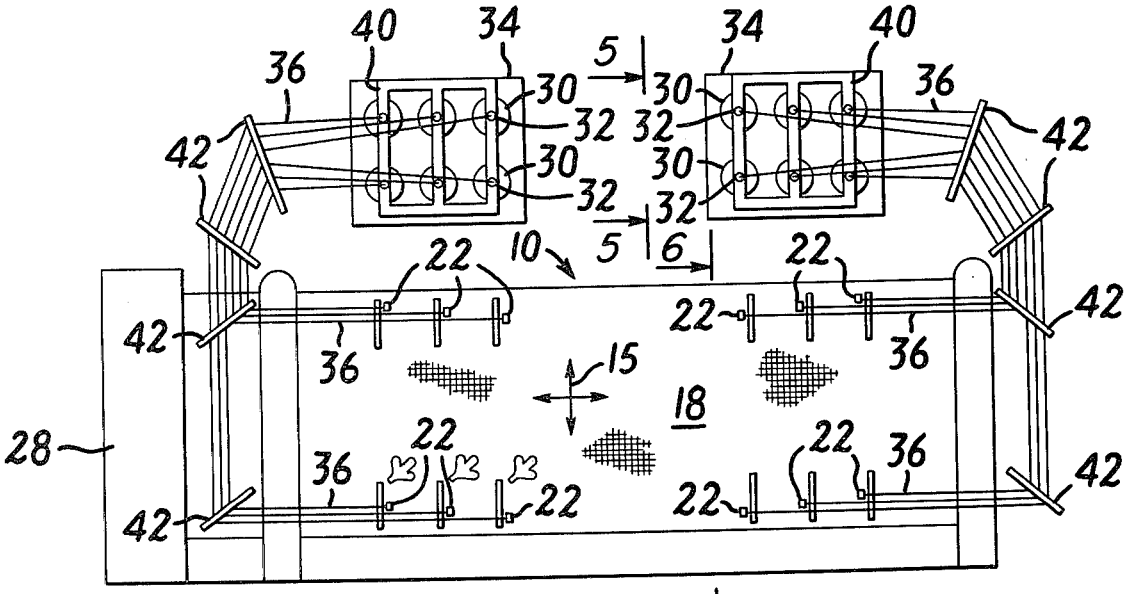
FIG. 4 is a front elevational view of the machine of FIG. 1 showing in schematic form the improved arrangement in accordance with the invention for mounting large cones of thread and a thread guidance system.

In accordance with the present invention, the conventional Schiffli embroidery machine as hereindescribed is modified to replace the spool arrangement with a thread supply system that is capable of utilizing cones of thread each having thread at least an order of magnitude by weight 15 to 20 times greater than each of the spools. As shown in FIG. 4, the improved thread supply system provides for mounting a plurality of cones 30 of thread at a distance from the needles 22 so that the size of the cones are not restricted by the spacing of the needles 22. In the preferred embodiment the cones 30 are mounted above the machine 10, although it should be understood that depending upon space availability the cones may also be disposed below or alongside the machine 10. The cones 30 are each mounted on a separate spindle 32 as shown more clearly in FIG. 5, the spindles 32 being affixed at a slight upward angle to a mounting support 34 that is suitably supported by means (not shown) above the machine 10. The spindles 32 are arranged to accommodate cones 30 having a radius greater than the spaced interval between the needles. In one example, a cone of lace thread has a diameter of about 5.0 inches, such a cone containing about 2.5–3.0 pounds of thread.

Figure 5:
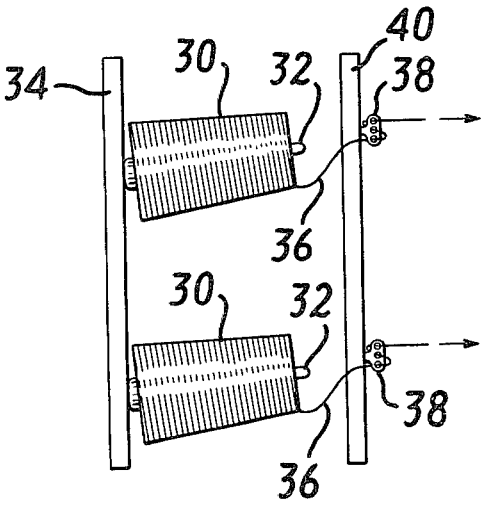
FIG. 5 is a side elevation view of the cones mounting arrangement and tension producing means as seen along viewing lines 5—5 of FIG. 4.

In accordance with the invention, the threads from each of the cone 30 mounted above the machine 10 are guided along a fixed path of travel to the respective needles 22. It is noted that the number of cones 30 of thread as depicted in FIG. 4, i.e., six cones mounted on two supports at each end of the machine 10, is for illustrative purposes and clarity of description, it being understood that any number of cones of thread at least equal to the number of needles 22 in the machine can be used in various suitable arrangements. As shown in FIG. 5, a thread 36 from each of the cones 30 is fed through a tension device 38 suitably connected to a bracket 40 preferably mounted proximate the spools 30. The tension device 38 in the preferred form is a member having three apertures through which the thread 36 is looped. Such a looping arrangement provides for tension in the free end of the thread 36 that emerges from the device 38 and that is subject to pulling while taking up any slack in the thread 36 before entering the device 38. It should be appreciated that other tension producing devices may also be used.

Interposed between the tension device 38 and the needles as illustrated in FIG. 4 are a series of thread guide plates 42 that are, in the preferred embodiment, angularly disposed at each end of the machine 10. These plates 42 guide the threads 36 from each of the cones 30 under tension produced in the device 38 along a fixed travel path to the needles 22. In the illustrated arrangement, the guide plates 42 direct the threads 36 to the upper and lower rows of needles 22. The plates 42 are arranged such that the threads 36 are directed substantially horizontally along the fabric 18 from each end of the machine 10 to the respective needles 22. At the location of each of the needles 22 a smaller guide plate 44 is provided to guide the thread 36 to the needle 22.

Figure 6:
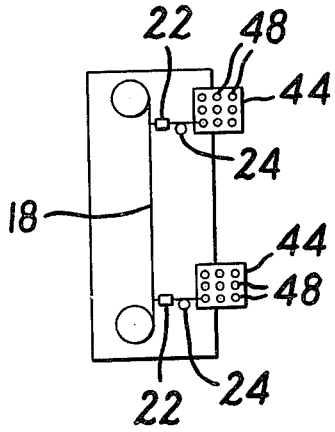
FIG. 6 is a side sectional view of the machine of FIG. 4 as seen along viewing line 6—6 in FIG. 4.
Figure 7:
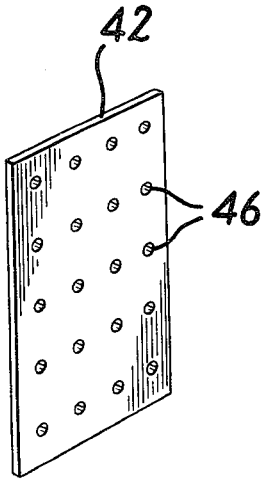
FIG. 7 is a perspective view of a thread guide plate in accordance with a preferred embodiment of the invention.

The guide plates 42 may be of any suitable material such as one-quarter inch thick MASONITE (Trademark) having a plurality of apertures 46 therethrough as shown in FIG. 7. Plastic grommets (not shown) may be pressed into each of the apertures 46 to provide a relatively smooth surface on which the threads 36 slide so as to minimize frictional problems. As shown in FIG. 6, the smaller plates 44 also have a plurality of apertures 48 through which the threads 36 pass for feeding to the emery roller 24 and thence to the needles 22. The smaller plates 44 may be one-sixteenth inch thick stainless steel stock and the apertures 48 may be countersunk to minimize sharp edges over which the threads pass.

In one application of the present invention, all the cones 30 contained 150 denier, two-ply RAYON (Trademark) threads each cone comprising about 2.5–3.0 pounds of such thread. Three hundred sixty (360) cones of this thread were mounted above the machine as hereindescribed. The threads from 180 cones were directed to each end of the machine, the guide plates 42 being disposed to guide 90 threads to each of the upper and lower rows of needles from each end of the machine. Such materials were used to make Venice laces primarily for bridal gowns and the like. In the embroidering of Venice laces, for example, the patterns that are stitched are typically repetitive and the materials used are usually of one shade or color, such as natural or white on white. The use of large cones of thread to allow relatively long continuous operation is ideal for embroidering Venice laces and other staples work where little changeover of materials is required. Of course, since the set up of the present mounting arrangement and the routing of threads from the spools to the needles is relatively time consuming, it can be appreciated that such an improvement as described herein with respect to Schiffli embroidery machines may have little utility in novelty work or in other machines where changeover of materials is required relatively often.

Not only is long-running operation achievable in accordance with the present invention but also an improvement in product quality. In the guidance system described herein, the tension in the threads is not primarily dependent upon the weight of the cone as is the tension with the conventional spool arrangement as it is pulled therefrom. The tension device of the present invention provides for a substantially uniform tension in the thread supplied to each needle thereby resulting in a substantially tight uniform stitch in the patterns embroidered on the fabric across the machine frame.

What is claimed is:

1. In an automatic shuttle embroidery machine of the type comprising a frame for holding in a substantially vertical plane a fabric onto which a pattern is to be embroidered, means for reciprocatably moving said frame along two perpendicular coordinates of said plane, a plurality of substantially horizontal reciprocatable needles supported on said machine to periodically stitch said fabric with thread, said needles being spaced along said frame in substantially equal intervals, means for supplying thread from a plurality of spools mounted in an arrangement substantially proximate said needles wherein each one of said spools is respectively associated with a needle for supplying thread thereto, the diameter of said spool being determined by the spaced interval between said needles and means for moving said needles in timed relation with said fabric to produce by stitching a pattern on said fabric of a particular configuration, the improvement comprising:

means for mounting a plurality of cones of thread at a location distant from said needles to replace said spools, said mounting means including means for supporting cones having a diameter greater than the diameter of said spools, means for producing tension in the thread from each cone, and means interposed between said cones and said needles for guiding said thread under tension along a fixed path from each of said cones to a respective one of said needles.

2. A machine according to claim 1, wherein the threads on each of said cones is substantially the same denier.

3. A machine according to claim 2, wherein the cones supported by said mounting means have a diameter such that the weight of thread on said cones is at least an order of magnitude greater than the weight of thread on said spools.

4. A machine according to claim 2, wherein said cones are mounted above said needles.

5. A machine according to claim 4, wherein a bracket comprising a tension device for each spool is mounted proximate said cones such that thread from each cone passes through a tension device for providing substantially uniform tension thereto.

6. A machine according to claim 5, wherein said guide means comprises a series of angularly disposed plates having a plurality of apertures through which said threads under tension pass and which directs said threads to the respective needles.

7. In an automatic shuttle embroidery machine of the type comprising a frame for holding in a substantially vertical plane a fabric onto which a pattern is to be embroidered, means for reciprocatably moving said frame along two perpendicular coordinates of said plane, a plurality of substantially horizontal reciprocatable needles supported on said machine to periodically stitch said fabric with thread, said needles being spaced along said frame in substantially equal intervals, means for supplying said thread to said needles and means for moving said needles in timed relation with said fabric to produce by stitching a pattern on said fabric of a particular configuration, the improvement wherein, said thread supplying means comprises means for mounting a plurality of cones of thread at a location distant from said needles, said mounting means including means capable of supporting cones having a radius greater than the spaced interval between said needles, means for producing tension in the thread from each cone, and means interposed between said cones and said needles for guiding said thread under tension along a fixed path from each of said cones to a respective one of said needles.

* * * * *

UNITED STATES PATENT AND TRADEMARK OFFICE

CERTIFICATE OF CORRECTION

PATENT NO. : 4,308,812

DATED : January 5, 1982

INVENTOR(S) : Harry Lenson

It is certified that error appears in the above-identified patent and that said Letters Patent are hereby corrected as shown below:

Abstract: line 1, change "coventional" to --conventional--

Detailed Description: Col. 4, line 8, change "cones of thread each having thread at least" to --cones of thread each thread having at least--.

Signed and Sealed this

Tenth Day of August 1982

[SEAL]

Attest:

GERALD J. MOSSINGHOFF

Attesting Officer

Commissioner of Patents and Trademarks